US006598430B2

(12) United States Patent
Ruoff et al.

(10) Patent No.: US 6,598,430 B2
(45) Date of Patent: Jul. 29, 2003

(54) COMPOUND NEEDLE

(75) Inventors: Klaus Ruoff, Albstadt (DE); Norbert Gomeringer, Gammertingern-Felhausen (DE); Andreas Dietz, Balingen (DE)

(73) Assignees: Groz-Beckert KG, Albstadt (DE); Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/175,862

(22) Filed: Jun. 21, 2002

(65) Prior Publication Data

US 2003/0005730 A1 Jan. 9, 2003

(30) Foreign Application Priority Data

Jun. 23, 2001 (DE) ..... 101 30 364

(51) Int. Cl.[7] ..... D04B 35/06
(52) U.S. Cl. ..... 66/120
(58) Field of Search ..... 66/116, 120, 123

(56) References Cited

U.S. PATENT DOCUMENTS 1,673,634 A * 6/1928 Page ..... 66/120
3,449,930 A * 6/1969 West et al. ..... 66/120
3,584,481 A * 6/1971 Hayashi ..... 66/120
4,043,153 A 8/1977 Lindner et al.
5,937,673 A * 8/1999 Shima ..... 66/120
6,233,977 B1 5/2001 Schuler et al.
6,422,045 B1 * 7/2002 Morita et al. ..... 66/120

FOREIGN PATENT DOCUMENTS

| | | |
|---|---|---|
| DE | 31 43 743 A1 | 5/1983 |
| DE | 44 30 705 A1 | 3/1996 |
| EP | 1 039 003 A1 | 9/2000 |
| WO | WO 01/31101 A1 | 5/2001 |

* cited by examiner

*Primary Examiner*—Danny Worrell
(74) *Attorney, Agent, or Firm*—Venable LLP; Norman N. Kunitz

(57) ABSTRACT

A compound needle (1) is provided with a slider (8) having two slider springs (11, 12). These are arched away from each other in a section immediately adjoining their insertion funnel (28). The compound needle has a slider slit (4), which initially is relatively narrow at its inlet (15), so that a guide section (4*a*) has been established there. Thereafter the slider slit (4) widens, so that a running section (4*b*) is established. The lateral bulge of the slider springs (11, 12) is of such a dimension that the slider (8) runs free in the running section (4*b*), and is guided without lateral play in the guide section (4*a*). The compound needle (1) also operates precisely in case of tension forces acting laterally on the slider (8) and requires only a small opening width of its funnel (28).

11 Claims, 4 Drawing Sheets

COMPOUND NEEDLE

COMPOUND NEEDLE

Figure 1:
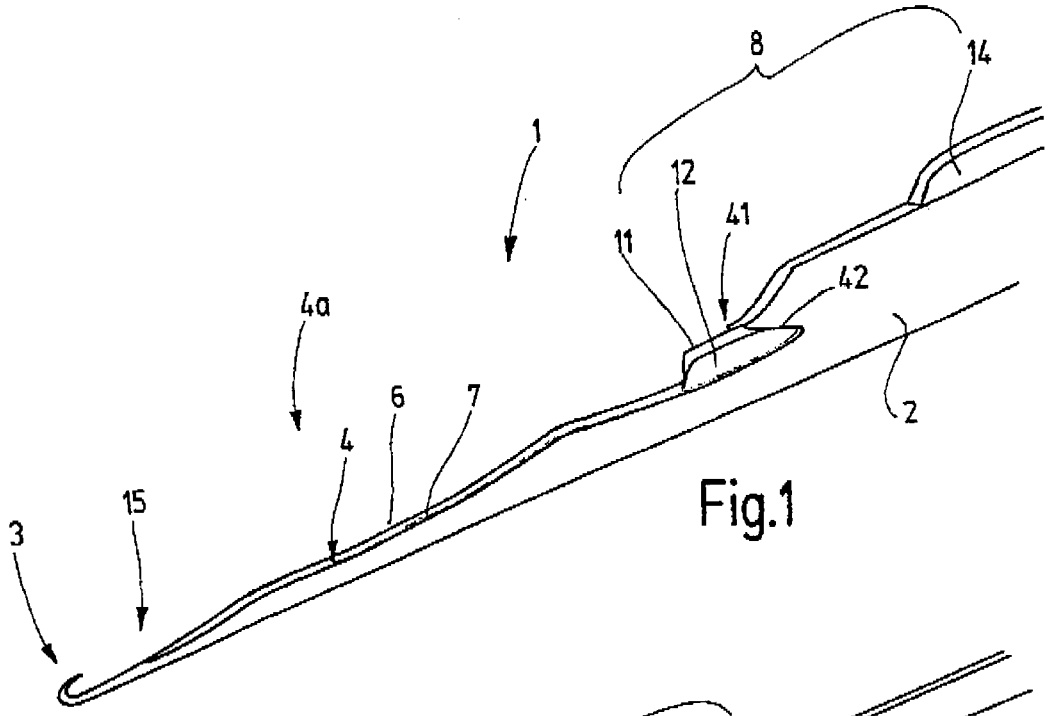

The invention relates to a compound needle, in particular for loop-forming textile machines.

A compound needle is know from DE 25 37 502. It has an elongated based body, which makes a transition into a hook at one end. Two slit walls, which are arranged spaced apart and parallel, start at a location opposite the open side of the hook and extend along the shank. A slider slit is formed between the slit walls. A slider, which can be longitudinally displaced and consists of two slider springs resting flat against each other, is arranged in the slider slit. The springs are approximately rectangular in cross section. The slider can touch the hook, or at least a hook tip, with its upper corner section when the slider is displaced in the direction toward the hook. For this purpose, the two slider springs are slightly bent away from each other on their corresponding upper corner sections in order to form in this way a funnel for receiving the hook tip. This funnel opens in a direction obliquely in respect to the movement direction of the slider.

In order to let both outward bent corners of the slider enter into the slider slit, the latter is widened in an upper narrow strip-shaped section. But the section of the slit close to the bottom is narrower. The bottom of the slider slit is substantially level, the slider performs a purely axial movement, in the course of which the slider is provided with guidance in every position by the inner faces of the slit wall, whose distance is uniform.

A compound needle is furthermore known from DE 199 13 822 C2, whose characteristic feature resides in the design of the slider. The latter is constituted by two slider springs which are convexly bent away from each other. They are again bent away from each other at their two free ends facing the hook in order to form a receiving funnel for the hook tip. Good centering of the slider springs in the slider slit is achieved by the lateral bulge of the slider springs.
Because of their tendency to spring away from each other, the slider springs rest resiliently against the slit walls.

Guidance of the slider has been proven to be especially good if the slider slit is narrow, so that the slider springs are well centered. Because of this the slider is also relatively insensitive against a lateral pull emanating, for example, from obliquely extending loops.

For its movement the slider requires a force which overcomes the slider friction in the slider slit. The slider friction is a function of the funnel size, for example. If the slider springs are spread far apart at their free ends, so that a large funnel is formed, which also assuredly meets the hook even at lateral yarn tension, an increased slider friction results.

A further problem lies in that the slider friction is considerably increased when dirt, fiber remnants and the like enter into the slider slit. This can lead as far as to the compound needle becoming inoperative.

It is the object of the invention to create a compound needle which is only a little, or not at all sensitive to lateral yarn tension and has reduced slider friction.

This object is attained by means of a compound needle having the characteristics of claim 1.

Figure 4:
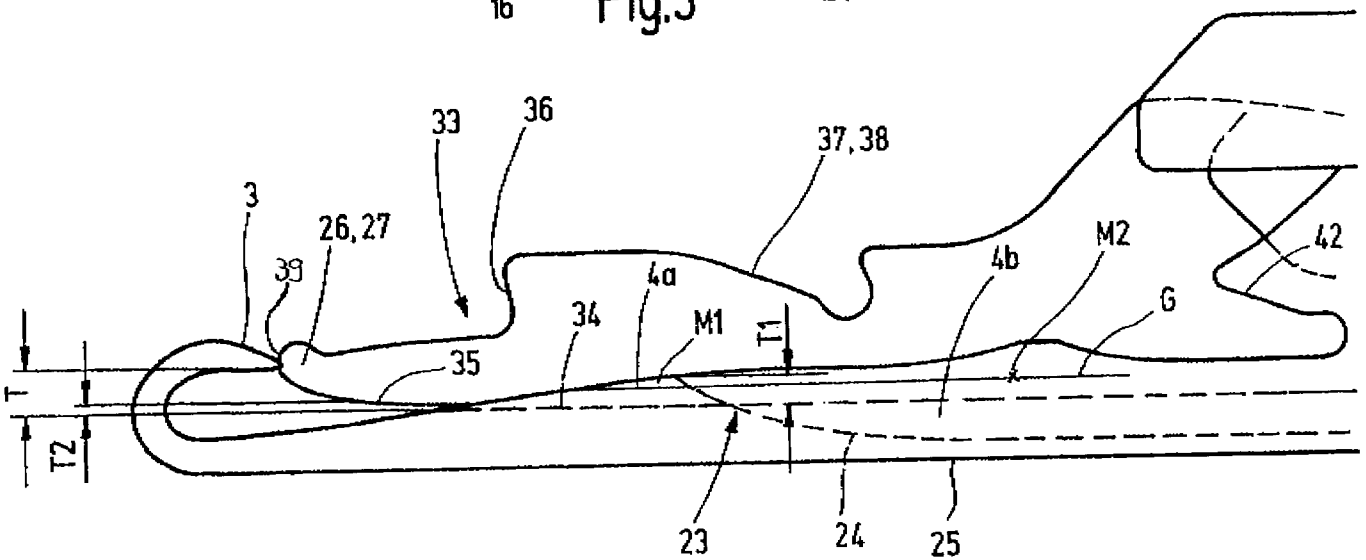

The compound needle of the invention has a slider with at least two slider springs running in a slider slit. The slider can be made of one piece or of several individual elements (slider spring, slider body), which are releasably or permanently connected with each other. On its end facing the hook, the slider slit is narrower in a first guide section than in the remaining section. The width or (synonymously) breadth of the slider slit is greater in the second guide section than in the first guide section, each measured at the same height over the needle back. If both measuring locations M1, M2 are connected with each other via an imagined straight line G, this straight line G extends parallel with the needle back (FIG. 4). The first guide section is narrower over its entire height than the second guide section adjoining the first guide section in the longitudinal needle direction. In addition, each of the slider springs is convexly curved toward the outside. The width of the slider slit is embodied to be stepped in the longitudinal direction. At its inlet (a location at the front in the longitudinal direction) it is narrow and, remote from the inlet (a location at the back in the longitudinal direction), it is wide in its second guide section, i.e. it is narrower in the vicinity of its inlet located directly opposite the hook than in the remainder. Both guide sections can partially overlap. It is also conceivable for the slider slit, or at least the second guide section, to assume a stepped embodiment shape, or one deviating from a U-shape, partially or over its entire length.

The lateral bulge of the slider springs is preferably fixed in such a way that it is located in the narrowed slider section when the free ends of the slider springs, which form a funnel, are pushed over the hook tip. The length of the narrowed section and the position of the convex sections of the slider springs are fixed in such a way that, when the slider is pushed in the direction toward the hook, the convex sections of the slider springs enter the narrowed slit section before the funnel reaches the hook tip. By means of this the funnel is precisely centered shortly before arriving at the hook tip, so that it can be kept very narrow and meets the hook centered, despite lateral yarn tension. On the other hand the slider friction is generally low because, as soon as the slider is pulled back from the hook, the laterally convex slider spring sections come into the widened slit, in which they run on the slit walls at low spring tension or even with play.

Dirt and fiber remnants can also be deposited in the widened slit section (second guide section) without the ability of the compound needle being affected too much. Thus, the compound needle in accordance with the invention is less susceptible to soiling.

The fact that the free ends of the slider springs forming the funnel spread away from each other as soon as the convex section of the slider springs enters the narrowed slit section constitutes an additional effect which permits a particularly narrow outlay of the funnel. There, the convex section of the slider springs are moved toward each other (pressed together), because of which the free ends of the slider springs can be spread away from each other to a width which exceeds the slit width. By means of this it is possible to assure a particular dependable working of the compound needle.

The curvature of the slider springs is preferably of such a size that the outer funnel width is approximately as large as the slit width of the slider slit or slot when the convex sections of the slider springs are located in the widened section of the slider slit. This assures a low slider friction, because the slider springs can relax in the slider slit. Preferably the convex sections rest without bias in the widened slit.

The slider friction at the slit flanks is essentially limited to the narrow front slit section. A high moment of resistance against lateral loop tension, as well as low friction, i.e. a smooth moving slider, is achieved by means of this.

The compound needle has an arrangement which, when the slider is retracted, causes it to dip into the slider slit. As known per se (for example from WO 01/311010), the slider slit has a bottom guide surface for guiding the slider elements at its inlet for this purpose. This forms a movement base for the slider springs. A recessed bottom area is provided adjoining this movement base, which is at a lesser distance from the needle back than the bottom guide surface. With an identical height of the slit wall, this results in a depression in the slider slit. Viewed from the inlet of the slider slit, the bottom guide surface first extends straight at a slightly greater distance from the needle back, and then approaches to the needle back and extends parallel with the needle back at a lesser distance from the needle back. Because of this the slider spring can dip at the same time it is retracted, i.e. be pulled back into the deepened slider slit area below the upper slit wall edge. This has meaning in connection with particularly fine knit goods, wherein small loops are to be formed and a low shank height, as well as only a small increase in the shank height in the direction away from the hook, is desired. At the location where the bottom guide surface ends and the slit bottom extends downward toward the needle back, the slider preferably enters the slider slit with the tips of its slider springs. A total of three guide surfaces are formed at the slit inlet in this way. These are the two oppositely placed inner faces of the slit wall and the bottom guide surface between them. Together, these three surfaces form a guide means or a guide arrangement and, in respect to the funnel spreading, simultaneously an actuating means. The latter, because the inner faces of the slit wall compress the slider springs as soon as the convex sections of the latter enter between them. The remaining slit is used as a guide space into which the slider can be retracted and runs with litter friction or with play. Precise guidance of the slider is only provided when its slider springs forming the funnel exit the slider slit, i.e. when its convex sections which spring away from each other move to the inlet in the first guide section.

As known from WO 01/31101), a cam guide can be provided on the needle body for controlling the dipping of the slider into the slider slit, which is engaged by correspondingly curved sections of the slider springs when the slider is retracted. The roller neck guide is constituted, for example, by two guide surfaces provided on the needle body, which are arranged obliquely in respect to the needle body, and to which guide surfaces of the slider spring oriented at the same angle are assigned. In the course of retracting the slider, the guide surfaces come into contact with each other and cause a downward movement of the slider, so that it dips into the slider slit (and therefore nears the needle back).

Figure 2:
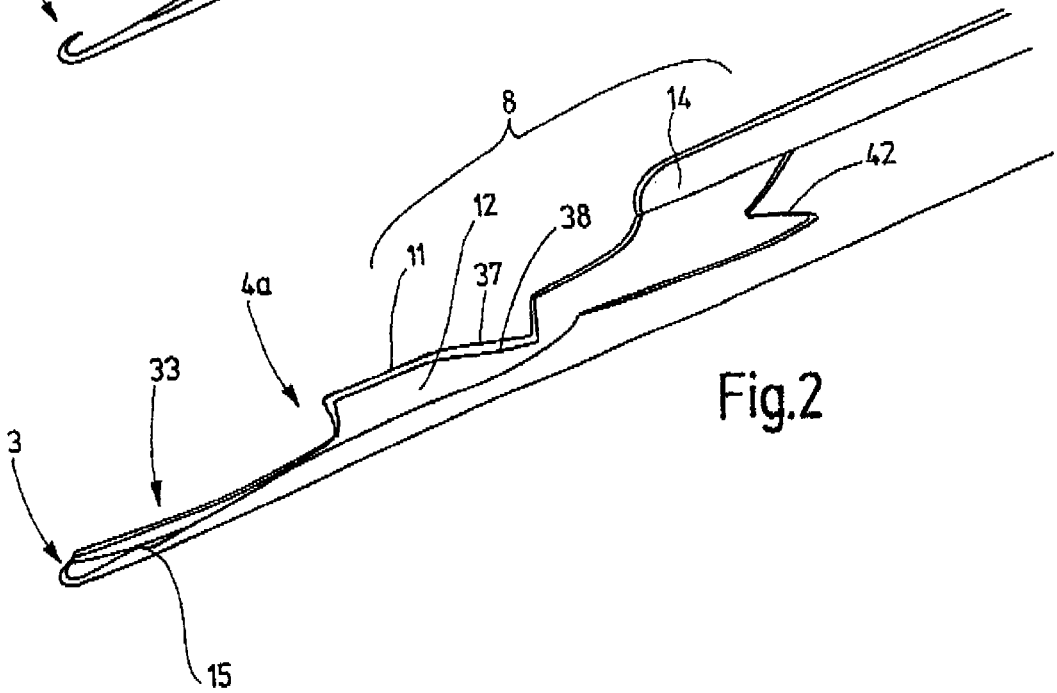
Figure 3:
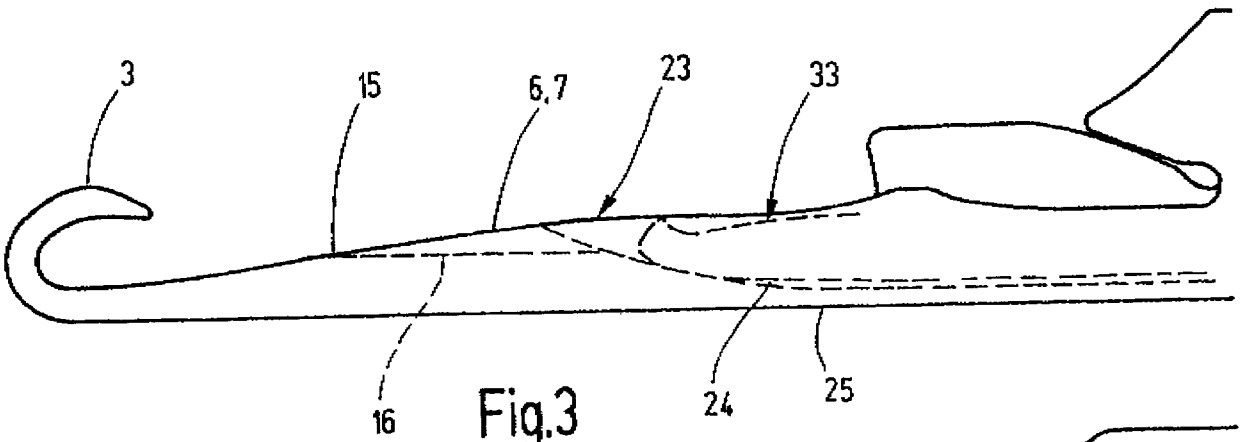
Figure 5:
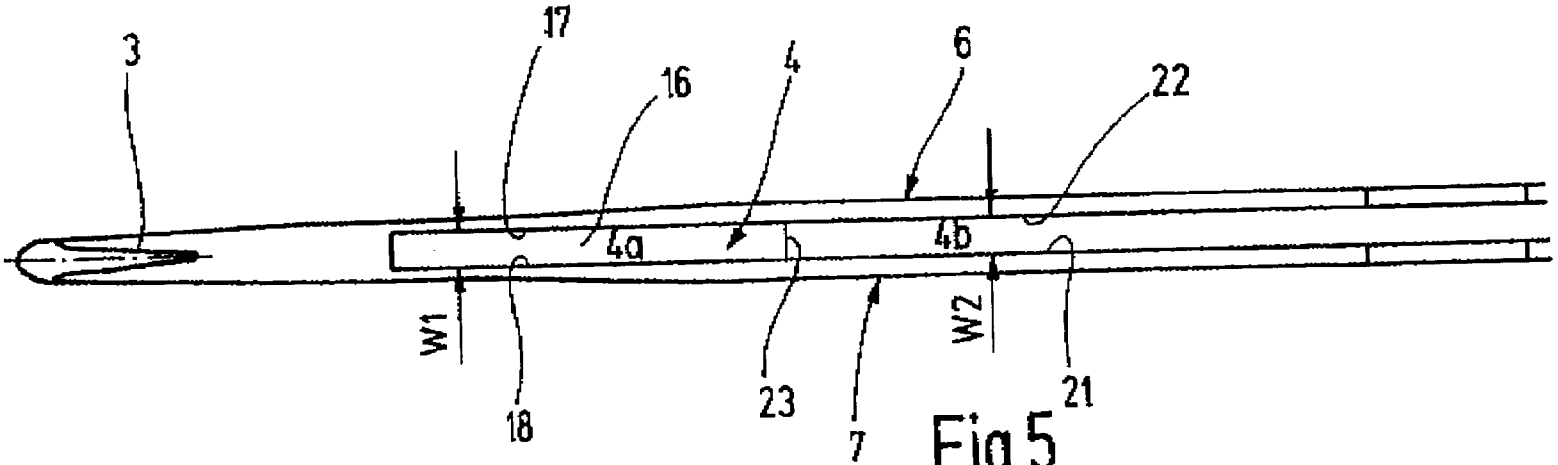
Figure 6:
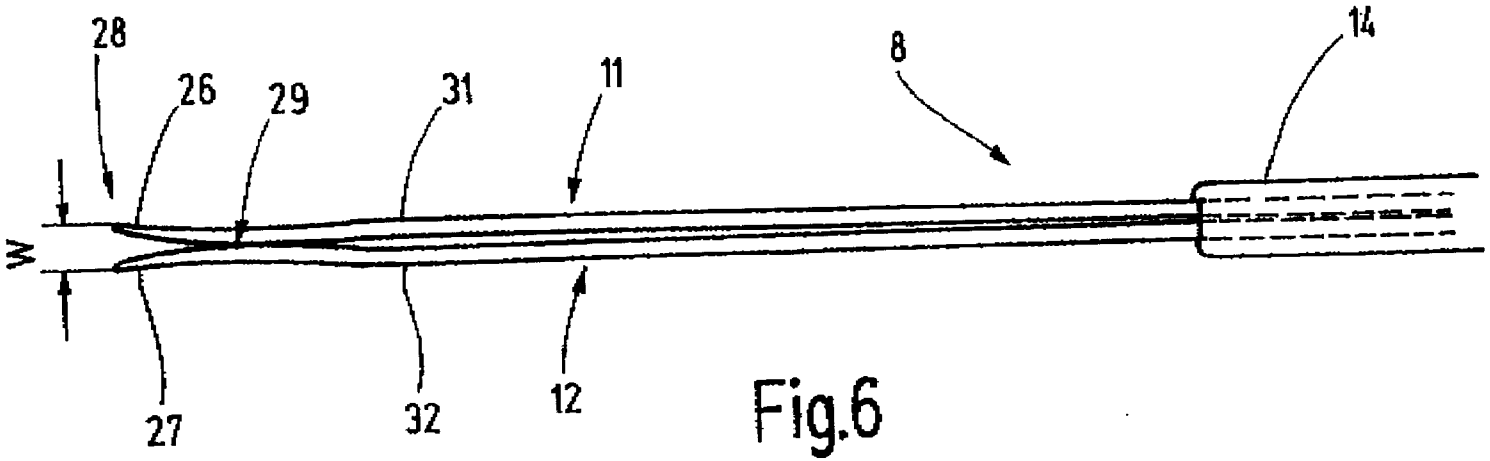
Figure 7:
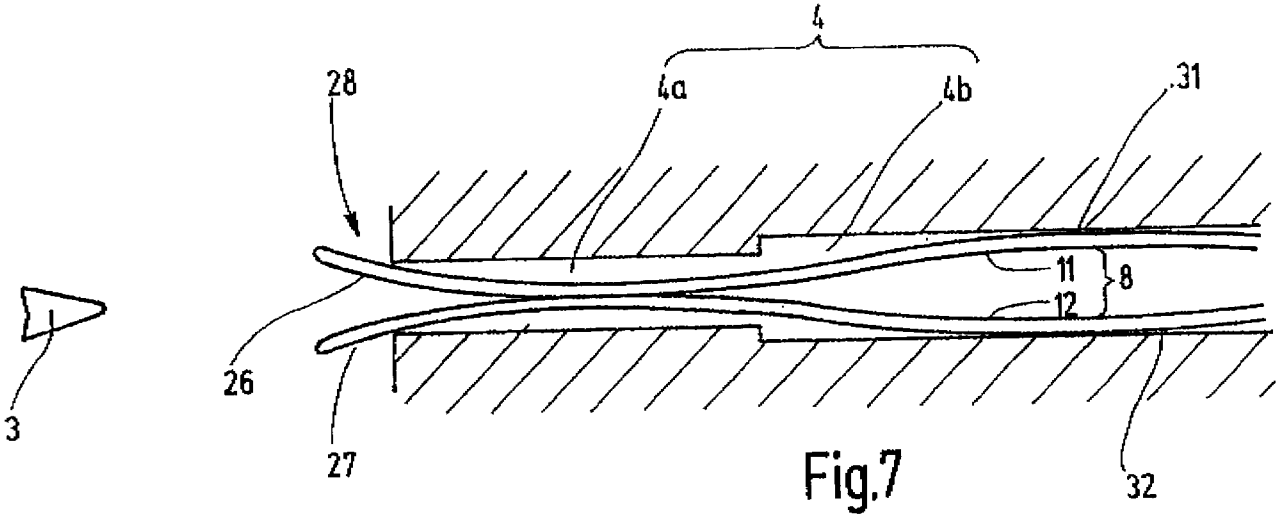
Figure 8:
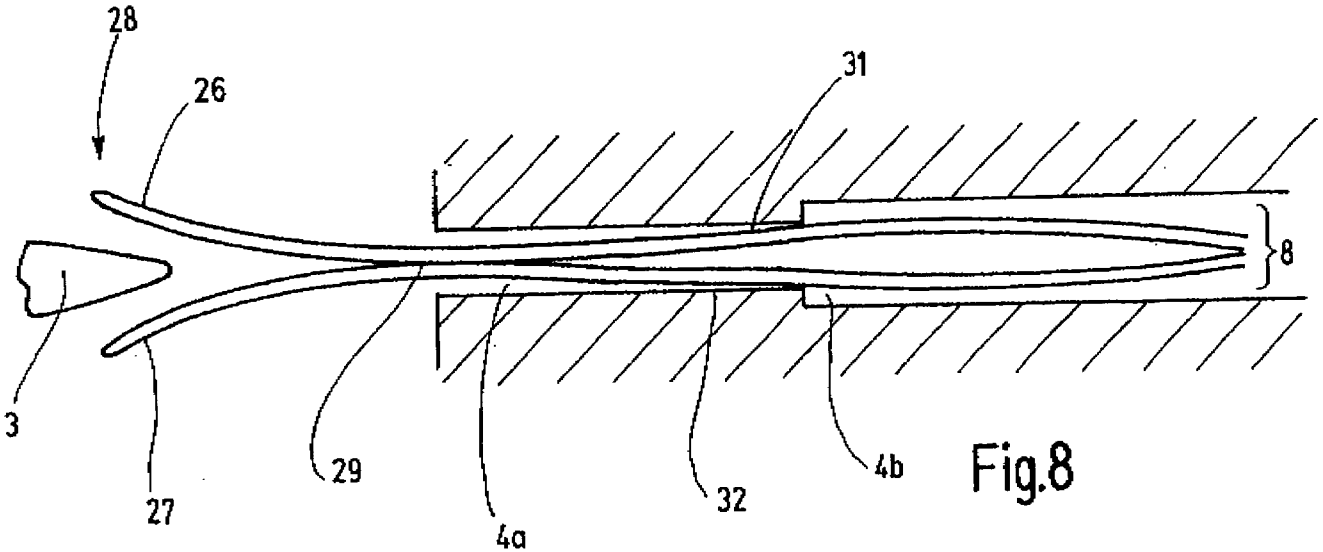

Details of advantageous embodiments of the invention ensure from the drawings, the description or dependent claims. An exemplary embodiment of the invention is illustrated in the drawings. Shown are in:

FIG. 1, a compound needle with retracted slider (with open yarn chamber) in a partial perspective representation, FIG. 2, the compound needle in accordance with FIG. 1 with the slider moved forward (with closed yarn chamber) in a partial perspective representation, FIG. 3, the compound needle in accordance with FIG. 1 in a partial lateral view, FIG. 4, the compound needle in accordance with FIG. 2 in a partial lateral view, FIG. 5, the compound needle without slider in a partial view from above, FIG. 6, the slider of the compound needle in a view from above, FIG. 7, a functional representation of the slider slit and the slider of the compound needle in the position in accordance with FIG. 1 in a schematic view from above, and FIG. 8, a functional representation of the slider slit and the slider of the compound needle for a position located between the positions in accordance with FIGS. 1 and 2 in a schematic view from above.

A compound needle 1 having a needle body 2 with a hook 3 formed at its end is illustrated in FIG. 1. A slider slit 4 begins opposite the hook 3 and is bordened by two slit walls 6, 7, which are parallel with each other and can be seen by way of example in FIG. 5. A slider 8 is arranged in the slider slit 4, which can be moved toward the hook 3, as shown in FIG. 2, and away from the hook 3, as shown in FIG. 1. The slider 8 has two slider springs 11, 12, which are separately shown in FIG. 6 and are attached to a slider body 14.

The structure of the slider slit 4 can be seen in particular in FIGS. 3 to 5. In accordance with that, the slit walls 6, 7, which border the slider slit 4 end level at a location 15 near the hook 3. The location 15 represent the inlet of the slider slit 4. A bottom guide surface 16 forming the slit bottom is shown in dashed lines in FIG. 3 and which is substantially level, starts at the location 15. The slider slit 4 has a width W1 (FIG. 5) in this area, Here, the two inner faces 17, 18 of the slit walls 6, 7, which face each other, are at the distance W1 from each other and in this way constitute lateral guide surfaces. Thus the area 4*a* of the slider slit 4 bordered by the bottom guide surface 16 and the inner faces 17, 18 forms a first guide section. The remaining area 4*b* of the slider slit 4 forms a second guide, or running section, or clearance section, in which the slider 8 can run under reduced guidance, but also with reduced friction. The running section 4*b* is widened over its entire height. Here, the slit walls 6, 7 have inner faces 21, 22, whose distance W2 is greater than the distance W1. Furthermore, the slit bottom is recessed in the running section 4*b*. At a location 23, where the inner faces 17, 18 make a transition, for example by means of a step, into the inner faces 21, 22, the bottom guide surface 16 also makes a transition into a recessed bottom section 24. The inner faces 21, 22 extend parallel with each other and at the same distance from each other over the entire height starting at this recessed, i.e. brought closer to the needle back 25, section of the slider slit 4. Thus, the slider slit 4 is narrow (W1) over the entire height at the inlet and wide (W2) over the entire height in the remaining part.

The slider springs 11, 12 running in the slider slit 4 are separately illustrated in FIG. 6. They have free ends 26, 27 which are bent away from each other and in this way form a funnel 28. The funnel 28 is open in the direction toward the hook 3. The opening direction extends approximately parallel with the needle back 25, or the bottom guide surface 16. Starting at their free ends 26, 27, the slider springs 11, 12 are bent toward each other, wherein they initially touch at a location 29. Continuing from this location 29, the slider springs 11, 12 are again bent laterally curved away from each other. In this case the bulge is approximately of such a size that the distance of the flanks 31, 32 from each other approximately corresponds to the outer funnel width W. The flanks 31, 32 represent those locations of the exterior of the slider springs 11, 12 which are farthest apart from each other in the relaxed state.

The contour of the slider springs 11, 12, offered in a lateral view, can be seen in particular in FIG. 4. Both slider springs 11, 12 are embodied symmetrically in respect to each other, at least in the area visible in FIG. 4. The slider springs 11, 12 have a front yarn reception section 33, which is used for opening and closing the yarn chamber, as well as for transferring loops. The length of the yarn reception section 33 approximately corresponds to the distance between the hook tip and the start of the slider slit 4 (location 15). The location 29 is arranged in the yarn reception section 33, thus the funnel 28 is short and, with the yarn chamber closed, the flanks 31, 32 are found in the guide section 4*a* of the slider slit 4. In exactly this area the slider springs 11, 12 are provided with a lower sliding edge 34 which, when the funnel 28 has just been pushed over the hook tip, rests against the bottom guide surface 16. Starting from the latter, the lower edges 35 slowly rise in the direction toward the slider spring tip 39, which is indicated by the value T2 in FIG. 4. T2 identifies the distance from the bottom guide surface to the location 29, at which the two free ends 26, 27 of the slider springs 11, 12 touch. In FIG. 4 the distance between the slider spring tip 39 and the bottom guide surface 16 is identified by T. This distance is greater than the height T1 of the slit wall 6, 7 in the guide section 4*a*. Because of this it is possible that during the retraction of the slider the slider tips of the funnel 28 are only retracted in the second further slider section. When displacing the slider 8 in the direction toward the hood 3, the ends 26, 27 of the slider springs 11, 12, which are spread away from each other, are lifted above the first guide section 4*a*. This has the result that, in spite of being spread apart, the ends 26, 27 do not touch the steps (location 23) formed between the guide sections 4*a*, 4*b*. From the first guide section 4*a*, the slider springs 11, 12 are guided into an area located underneath the spread ends 26, 27. The ends 26, 27 do not come into contact with the first guide section. In addition, a slim shank is obtained, which permits the formation of particularly fine loops.

The ends 26, 27 of the slider springs 11, 12 are preferably flattened toward the tip 39 (FIG. 6). This assures the reception of the hook tip 3 between the ends 26, 27 even with advanced wear.

A shoulder 36 used for positioning the loops adjusts the yarn reception section 33. Adjoining the shoulder 36, the slider springs 11, 12 are slightly bent outward, as indicated in FIGS. 1 and 2, so that the respective sections with guide surfaces 37, 38 project laterally past the slider slit 4. The guide surfaces 37, 38 are arranged obliquely in respect to the needle back 25. Their inclination approximately corresponds to the inclination of the transition from the bottom guide surface 16 to the recessed bottom section 24. Corresponding guide surfaces 41, 42 are embodied as counter-surface with the same inclination at protrusions of the slit walls 6, 7. The protrusions constitute a guidance cam for the slider 8 in order to guide it sufficiently downward in the running section 4*b* that, as illustrated in FIG. 3, the yarn reception section 33 disappears below the upper slit edge of the slider slit 4. For this purpose the distance between the recessed bottom section 24 and the upper edge of the slit walls 6, 7 is greater than the corresponding height of the slider springs 11, 12.

The compound needle so far described operates as follows:

During operation the compound needle 1 is inserted into a needle groove of a knitting machine and there performs a reciprocal movement along its needle back 25. For opening and closing the hook chamber, as well as for transferring yarn to other knitting tools, the slider 8 is appropriately moved in relation to the needle body 2. If the slider 8 is entirely pulled into the slider slit 4 for completely releasing the hook 3, the slider 8 leaves the guide section 4*a* and therefore comes completely into the running section 4*b*, in which it can be displaced with little friction. This applies in particular if it is preferred that the distance W (FIG. 6) is less, or at most only slightly greater, than the distance W2 (FIG. 5). In this way the needle wear, as well as the wear of a drive mechanism for the slider 8, are minimized.

But if the slider 8 is moved toward the hook 3 for closing the yarn chamber, the slider 8 is first slightly raised during the transition from the running section 4*b* into the guide section 4*a*, so that its sliding edge 34 reaches the bottom guide surface 16. In addition, the flanks 31, 32 of the slider springs 11, 12 reach the guide section 4*a*, which is narrower than the rest of the slider slit 4. In this way the slider 8 is provided with precise centering through the guide section 4*a*. The slider springs 11, 12 rest resiliently with bias against the inner faces 17, 18. Lateral forces acting on the yarn reception section 33, such as can occur because of oblique tension by loops, as absorbed by the bias of the slider springs and will not result in an inaccurate centering of the slider 8. In this way it is possible to push the narrow funnel 28 precisely on the slim tip of the hook 3 without missing it. Therefore the danger of a free end 26, 27 of a slider spring 11, 12 abutting the hook tip, or passing it on the wrong side does not exist. Therefore the compound needle operates with improved guidance of the slider 8 in spite of the reduced friction of the latter, and thus with greater precision.

A further effect, which illustrated exaggerated in FIGS. 7 and 8, can be caused by means of the narrowing of the slider slit 4 in the guide section 4*a* and of the lateral bulge of the slider springs 11, 12:

The slider slit 4 and the slider springs 11, 12 are illustrated in FIG. 7 in a position in which the flanks 31, 32 have not yet reached the first guide section 4*a*. The funnel 28, i.e. the free ends 26, 27 thereof, are or is far away from the hook 3. Therefore the slider springs 11, 12 are relaxed to a large extend and slide in the running section 4*b* with little friction, or even with play.

But in FIG. 8 the flanks 31, 32 have already entered the guide section 4*a*. The latter is narrower than the running section 4*b* and therefore slightly compresses the slider springs 11, 12. Therefore the slider springs 11, 12 roll off on each other at the location 29, and the ends 26, 27 are spread apart. The spreading causes a widening of the funnel 28, which can now be perceptively wider than the slider slit 4. This state has been achieved by means of the appropriate dimensioning of the lengths of the slider springs 11, 12, and of the arrangement of the flanks 31, 32, in particular in comparison with the arrangement of the guide section 4*a*, when the funnel 28 arrives at the tip of the hook 3. In other words, the distance of the hook tip to the center of the guide section 4*a* is approximately as great as the distance of the free ends 26, 27 to the flanks 31, 32. In this way the widened funnel 28 encounters the hook 3 with great dependability in such a way that the hook 3 enters the funnel 28 without touching it. Even a strong tension acting laterally on the slider 8 can hamper functioning. The slider springs 11, 12 together with the guide section 4*a* act like a tweezer which, in the course of pushing the slider 8 forward, opens for receiving the hook, but closes again during retraction, so that the slider 8 as a whole runs with littler friction in the slider slit 4.

A compound needle 1 is provided with a slider 8 having two slider springs 11, 12. These are arched away from each other in a section immediately adjoining their insertion funnel 28. The compound needle has a slider slit 4, which initially is relatively narrow at its inlet 15, so that a guide section 4*a* has been established there. Thereafter the slider slit 4 widens, so that a running section 4*b* is established. The lateral bulge of the slider springs 11, 12 is of such a dimension that the slider 8 runs free in the running section 4*b*, and is guided without lateral play in the guide section 4*a*. The compound needle 1 also operates in case of tension forces acting laterally on the slider 8 and requires only a small opening width of its funnel 28.

List of Reference Numerals:

1 Compound needle
2 Needle body
3 Hook
4 Slider slit or slider slot
4*a* Guide section
4*b* Running section
6, 7 Slit walls
8 Slider
11, 12 Slider springs
14 Slider body
15 Location
16 Bottom guide surface
17, 18 Inner faces
21, 22 Inner faces
23 Location
24 Recessed bottom section
25 Needle back
26, 27 Free ends
28 Funnel
29 Location
31, 32 Flanks
33 Yarn reception section
34 Sliding edge
35 Edge
36 Shoulder
37, 38 Guide surfaces
39 Slider spring tip
41, 42 Guide surfaces
W1 Slider slit width, narrow
W2 Slider slit width, wide
W Outer funnel width
T Distance from hook to bottom guide surface
T2 Distance from bottom guide surface to location 29

What is claimed is:

1. A compound needle (1), in particular for hoop-forming textile machines, having a needle body (2), whose shank has a hook (3) with a tip at one end, having two slit walls (6, 7) provided on the shank and parallel with each other, which between themselves delimit a slider slit (4) of a width (W1, W2) which corresponds to the distance between the slit walls (6, 7), a. wherein the slider slit (4) has an inlet (15) which lies opposite the hook (3), and extends away from the inlet (15), and b. wherein the width (W1) of the slider slit (4) is less, at least at a location near the inlet (15), than the width (W2) measured at the same height in respect to the needle back at at least one location remote from the inlet (15), having a slider (8) which has at least two slider springs (11, 12), a. whose free legs (26, 27), which point toward the hook (3), are bent away from each other in order to form, starting at a contact location (29), a funnel (28) open toward the hook (3), b. which, adjoining the contact location (29), are bent away from each other at a location (31, 32) opposite the funnel (28), and c. which are arranged in the slider slit (4) so they can be pushed toward the hook (3) and away from it.

2. The compound needle in accordance with claim 1, characterized in that in its inlet (15) the slider slit (4) has a bottom guide surface (16) for guiding the slider springs (11, 12).

3. The compound needle in accordance with claim 1, characterized in that the compound needle (1) has an arrangement (16, 37, 38, 41, 42) for causing the slider (8) to dip into the slider slit (4) when the slider (8) is retracted.

4. The compound needle in accordance with claim 1, characterized in that above a recessed bottom section (24) the slider slit (4) has a greater width (W2) over the full height than in the inlet (15).

5. The compound needle in accordance with claim 2, characterized in that above the bottom guide surface (16), the slit walls (6, 7) have a height (T1) which is less than the height (T) of the slider spring tip (39).

6. The compound needle in accordance with claim 3, characterized in that above the recessed bottom section (24), the slit walls (6, 7) have a height which is greater than the height of the slider springs (11, 12) in a yarn reception section (33).

7. The compound needle in accordance with claim 1, characterized in that in a front functional section (33), which is used for loop transfer, the slider springs (11, 12) are embodied symmetrically in respect to each other.

8. The compound needle in accordance with claim 3, characterized in that guide faces (37, 38, 41, 42) provided on the needle body (2) and the slider springs (11, 12) are a part of the arrangement (16, 37, 38, 41, 42), and that the guide faces (37, 38, 41, 42) constitute a guidance arrangement which, in the course of the slider retraction behind the inlet (15) of the slider slit (4), imparts a lowering motion to the slider springs (11, 12) which is oriented in the direction towards the needle back (25).

9. The compound needle in accordance with claim 1, characterized in that the lateral bending of the slider springs (11, 12) is dimensioned in such a way that in a section (4*b*) of the slider slit (4) which lies remote from the inlet (15), the slider springs (11, 12) are relaxed in the slider slit (4).

10. The compound needle in accordance with claim 1, characterized in that the lateral bending of the slider springs (11, 12) is dimensioned in such a way that in a section (4*a*) of the slider slit (4) which lies close to the inlet (15), the slider springs (11, 12) are composed and the free ends (26, 27) of the slider springs (11, 12) are spread open.

11. The compound needle in accordance with claim 1, characterized in that the slider springs (11, 12) have a thickness which is reduced toward their respective tips (39).

* * * * *

UNITED STATES PATENT AND TRADEMARK OFFICE
Certificate

Patent No. 6,598,430 B2 Patented: July 29, 2003

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Klaus Ruoff, Albstadt, Germany; Norbert Gomeringer, Gammertingern-Felhausen, Germany; Andreas Dietz, Balingen, Germany; and Toshiaki Morita, Wakayama, Japan.

Signed and Sealed this Thirteenth Day of April 2004.

JOHN J. CALVERT
*Supervisory Patent Examiner*
Art Unit 3765